US009651037B2

(12) United States Patent
Sakakibara et al.

(10) Patent No.: US 9,651,037 B2
(45) Date of Patent: May 16, 2017

(54) CONTROL VALVE FOR A VARIABLE DISPLACEMENT COMPRESSOR

(71) Applicant: TGK CO., LTD, Tokyo (JP)

(72) Inventors: Hidekazu Sakakibara, Tokyo (JP); Takashi Kobayashi, Tokyo (JP); Michiyoshi Miyazaki, Tokyo (JP); Kotaka Tamotsu, Tokyo (JP); Satoshi Shimazaki, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 651 days.

(21) Appl. No.: 13/861,354

(22) Filed: Apr. 11, 2013

(65) Prior Publication Data

US 2013/0276920 A1 Oct. 24, 2013

(30) Foreign Application Priority Data

Apr. 23, 2012 (JP) ..... 2012-097869

(51) Int. Cl.
*F04B 27/18* (2006.01)
*F04B 1/26* (2006.01)
(Continued)

(52) U.S. Cl.
CPC ..... *F04B 27/1804* (2013.01); *F04B 1/26* (2013.01); *F04B 27/18* (2013.01); *F04B 49/02* (2013.01);
(Continued)

(58) Field of Classification Search
CPC .. F04B 1/29; F04B 1/295; F04B 27/18; F04B 27/1804; F04B 2027/1809;
(Continued)

(56) References Cited

U.S. PATENT DOCUMENTS 6,443,707 B1 * 9/2002 Kimura et al. ..... 417/222.2
6,688,853 B1 2/2004 Burkett et al. ..... 417/222.2
(Continued)

FOREIGN PATENT DOCUMENTS

EP 1111239 A2 6/2001 ..... F04B 27/18
JP 2009103116 A 5/2008
(Continued)

OTHER PUBLICATIONS

Machine translation of JP 2011-043102; Patent Translate EPO.*
(Continued)

*Primary Examiner* — Bryan Lettman
*Assistant Examiner* — Timothy P Solak
(74) *Attorney, Agent, or Firm* — Martine Penilla Group, LLP

(57) ABSTRACT

A control valve according to an embodiment includes a body having a valve hole and a guiding passage formed coaxially with the valve hole, an actuating rod, slidably supported along the guiding passage, which is provided with a valve element, a solenoid for applying the solenoidal force in an opening or closing direction of a valve section to the valve element via the actuating rod, and a seal section, provided between the actuating rod and the guiding passage, which houses a sealing member for restricting the leakage of refrigerant from a high pressure side to a low pressure side. The actuating rod and the guiding passage are configured such that the clearance, between the actuating rod and the guiding passage, which is at a higher-pressure side of the seal section is larger than the clearance which is at a lower-pressure side of the seal section.

7 Claims, 10 Drawing Sheets

(51) Int. Cl.

| | |
|---|---|
| ***F04B 49/02*** | (2006.01) |
| ***F04B 49/22*** | (2006.01) |
| ***F25B 1/02*** | (2006.01) |
| *F04B 53/10* | (2006.01) |

(52) U.S. Cl.
CPC ..... *F04B 49/22* (2013.01); *F25B 1/02* (2013.01); *F04B 53/1082* (2013.01); *F04B 2027/185* (2013.01); *F04B 2027/1813* (2013.01); *F04B 2027/1827* (2013.01); *F04B 2027/1845* (2013.01); *Y10T 137/794* (2015.04); *Y10T 137/85978* (2015.04)

(58) Field of Classification Search
CPC ..... F04B 2027/1813; F04B 2027/1818; F04B 2027/1822; F04B 2027/1827; F04B 2027/1831; F04B 2027/184; F04B 2027/1845; F04B 2027/185; F04B 2027/1859; F04B 49/02; F04B 49/06; F04B 49/22; F04B 53/20; F04B 53/1082; F04B 39/16; F04B 49/03; F04B 49/002; F04B 49/12; F04B 1/26
See application file for complete search history.

(56) References Cited

U.S. PATENT DOCUMENTS

| | | | | |
|---|---|---|---|---|
| 2001/0013225 | A1 | 8/2001 | Ota et al. | 62/228.5 |
| 2004/0202552 | A1* | 10/2004 | Okii et al. | 417/222.2 |
| 2005/0008499 | A1* | 1/2005 | Umemura et al. | 417/222.2 |
| 2006/0086918 | A1* | 4/2006 | Koyama | 251/129.01 |
| 2006/0228227 | A1* | 10/2006 | Mori et al. | 417/222.2 |

FOREIGN PATENT DOCUMENTS

| | | | | | |
|---|---|---|---|---|---|
| JP | 2009041547 | A | | 2/2009 | F04B 27/14 |
| JP | 2009103116 | A | | 5/2009 | |
| JP | 2009103116 | A | | 5/2009 | F04B 27/14 |
| JP | 2009264127 | A | | 11/2009 | F04B 27/08 |
| JP | 2011-43102 | | * | 3/2011 | F04B 27/14 |
| JP | 2011043102 | A | | 3/2011 | |
| WO | WO 2008108093 | A1 | | 9/2008 | |
| WO | WO 2008/108093 | | * | 12/2008 | |
| WO | WO 2008/108093 | A1 | | 12/2008 | F04B 27/14 |

OTHER PUBLICATIONS

Chinese App. No. 201310115465.7, Dispatch Jan. 15, 2016, Office Action, TGK Co., Ltd.

Japanese App. No. 2012-097869, Dispatch Jan. 29, 2016, Office Action, Ref. TGK 12-101.

EP13163604, European Search Report, Apr. 29, 2016, Munich.

CN App. No. 201310115465.7, Notification of the Second Office Action, English translation, Aug. 29, 2016.

CN App. No. 201310115465.7, Notification of the Second Office Action, Chinese language, Aug. 29, 2016.

Japanese Office Action, Decision of Rejection, Reference No. TGK12-101, Control Valve for Variable Displacement Compressor, Sep. 20, 2016.

"5.3.3 O ring" on p. 412, line 13 to p. 414, line 2 of "JSME Mechanical Engineer's Concise Handbook, 6th Edition, Mar. 20, 2017, Maruzen", and an English translation thereof.

* cited by examiner

CONTROL VALVE FOR A VARIABLE DISPLACEMENT COMPRESSOR

CLAIM OF PRIORITY TO RELATED APPLICATION

The present application is claiming priority of Japanese Patent Application No. 2012-097869, filed on Apr. 23, 2012, the content of which is incorporated herein by reference.

BACKGROUND OF THE INVENTION

1. Field of the Invention

The present invention relates to a control valve suitable for controlling a discharging capacity of a variable displacement compressor.

2. Description of the Related Art

An automotive air conditioner generally includes a compressor, a condenser, an expander, an evaporator, and so forth. The compressor compresses a refrigerant flowing through a refrigerant cycle of the air conditioner and then discharges the thus compressed refrigerant as a higher-temperature and high-pressure gas refrigerant. The condenser condenses the gas refrigerant. The expander adiabatically expands the condensed liquid refrigerant so as to produce a low-temperature and low-pressure refrigerant. Then the evaporator evaporates the low-temperature and low-pressure refrigerant and thereby subjects the thus evaporated refrigerant to a heat exchange with the air inside the vehicle. The refrigerant evaporated by the evaporator is again brought back to the compressor, which in turn circulates through the refrigerant cycle.

Used as such a compressor as described above is a variable displacement compressor (hereinafter referred to simply as "compressor" also) capable of controlling the refrigerant discharging capacity in order to maintain a constant level of cooling capacity irrespective of the engine speed. This compressor has a piston for compression linked to a wobble plate that is mounted to a rotational shaft rotatingly driven by an engine. And the compressor controls the refrigerant discharge rate by changing the stroke of the piston through changes in the angle of the wobble plate. The angle of the wobble plate can be changed continuously by changing the balance of pressure working on both faces of the piston as part of the discharged refrigerant is introduced into an airtight crankcase. The pressure within this crankcase (hereinafter referred to as "crank pressure") Pc is controlled by a control valve for a variable displacement compressor (hereinafter referred to simply as "control valve" also), which is provided between the discharge chamber of the compressor and the crankcase or between the crankcase and the suction chamber thereof.

One of these control valves, such as one disclosed in Reference (1) in the following Related Art List, controls the crank pressure Pc by adjusting the amount of refrigerant introduced into the crankcase in accordance with a suction pressure Ps, for instance. This control valve includes, for example, a pressure-sensing section to develop a displacement by sensing the suction pressure Ps, a valve section for controlling the opening and closing of the passage from the discharge chamber to the crankcase in response to a drive force from the pressure-sensing section, and a solenoid capable of changing the setting value of the drive force at the pressure-sensing section by external electric current. The control valve like this opens and closes the valve section in such a manner as to maintain the suction pressure Ps at a pressure set by the external electric current. Generally, the suction pressure Ps is proportional to a refrigerant temperature at the exit of the evaporator, and thus the freezing or the like of the evaporator can be prevented by maintaining a set pressure at or above a predetermined value. Also, when the engine load of a vehicle is high, the compressor can be operated at the minimum capacity by fully opening the valve section with the solenoid turned off and by setting the wobble plate substantially at a right angle to the rotational shaft with the crank pressure Pc set high.

To accurately control the crank pressure Pc, such a control valve as described above is often provided with a seal structure by which to prevent the refrigerant from leaking from a high pressure side to a low pressure side at places excluding the valve section. In the structure described in Reference (1) in the following Related Art List, for example, a portion where a valve element is formed integrally with a rod and operates, namely, a guide hole joining a discharge chamber communicating port, which communicates to a discharge chamber, to a suction chamber communication port, which communicates with a suction chamber, functions as a sliding portion of a rod. And an O-ring is provided on the outer periphery of the rod. This structure can prevent a high-pressure refrigerant introduced from the discharge chamber communicating port from leaking into a low pressure chamber communicating with the suction chamber communicating port.

RELATED ART LIST (1) Japanese Unexamined Patent Application Publication (Kokai) No. 2011-43102.

In such a structure as described above, the O-ring is fitted on a recessed groove formed in the rod or guide hole. When, however, the clearance between the rod and the guide hole in the vicinity of the recessed groove is large, the O-ring is likely to be deformed toward the low pressure side due to a pressure difference between an upstream side and a downstream side, for instance, and therefore a sliding friction increases. When, on the other hand, the clearance between the rod and the guide is small, foreign material such as metallic powders is likely to enter a space therebetween, which may cause the malfunction of the valve section.

SUMMARY OF THE INVENTION

The present invention has been made in view of the foregoing problems, and a purpose thereof is to maintain the smooth operation of a valve element while the sealing property of a sliding portion is ensured in a control valve for a variable displacement compressor.

In order to resolve the aforementioned problems, a control valve, for a variable displacement compressor, according to one embodiment of the present invention is a control valve for a variable displacement compressor for varying a discharging capacity of the variable displacement compressor by controlling a flow rate of refrigerant to be introduced from a discharge chamber to a crankcase of the compressor, and the control valve includes: a body having a discharge pressure chamber that communicates with the discharge chamber, a crank pressure chamber that communicates with the crankcase, a valve hole provided in a passage joining the discharge pressure chamber to the crank pressure chamber, and a guiding passage formed coaxially with the valve hole; an actuating rod slidably supported along the guiding passage, the actuating rod having a valve element configured to open and close a valve section such that the valve element touches and leaves the valve hole; a solenoid configured to apply a solenoidal force in an opening or closing direction of the valve section to the valve element via the actuating rod; and a seal section provided between the actuating rod and the guiding passage, the seal section containing a sealing member therein where the sealing member serves to restrict leakage of the refrigerant from a high pressure side to a low pressure side. The actuating rod and the guiding passage are configured such that a clearance, between the actuating rod and the guiding passage, which is at a higher-pressure side of the seal section is larger than a clearance therebetween which is at a lower-pressure side of the seal section and a clearance length in the axial direction on the higher-pressure side of the recessed groove is shorter than a clearance length in the axial direction on the lower-pressure side of the recessed groove.

By employing this embodiment, the sealing member is pressed in such a manner as to close a low-pressure—side clearance due to a pressure difference between a high-pressure side and a low-pressure side. As a result, the sealing property of a sliding portion of the actuating rod can be satisfactorily maintained. Also, the low-pressure-side clearance is relatively small. This can prevent the problem of an excessive sliding friction caused by the sealing member stuck in the low-pressure-side clearance. At the same time, the high-pressure-side clearance is relatively large; if foreign material enters from the high pressure side, the occurrence of the foreign material being entangled can be prevented or suppressed. As a result, the smooth operation of the actuating rod and eventually the valve element can be maintained.

BRIEF DESCRIPTION OF THE DRAWINGS

Embodiments will now be described by way of examples only, with reference to the accompanying drawings which are meant to be exemplary, not limiting, and wherein like elements are numbered alike in several Figures in which.

DETAILED DESCRIPTION OF THE INVENTION

The present invention will now be described in detail based on preferred embodiments with reference to the accompanying drawings. This does not intend to limit the scope of the present invention, but to exemplify the invention. All of the features and the combinations thereof described in the embodiment are not necessarily essential to the invention.

In the following description, for convenience of description, the positional relationship in each structure may be expressed as "vertical" or "up-down" with reference to how each structure is depicted in Figures.

First Embodiment

Figure 1:
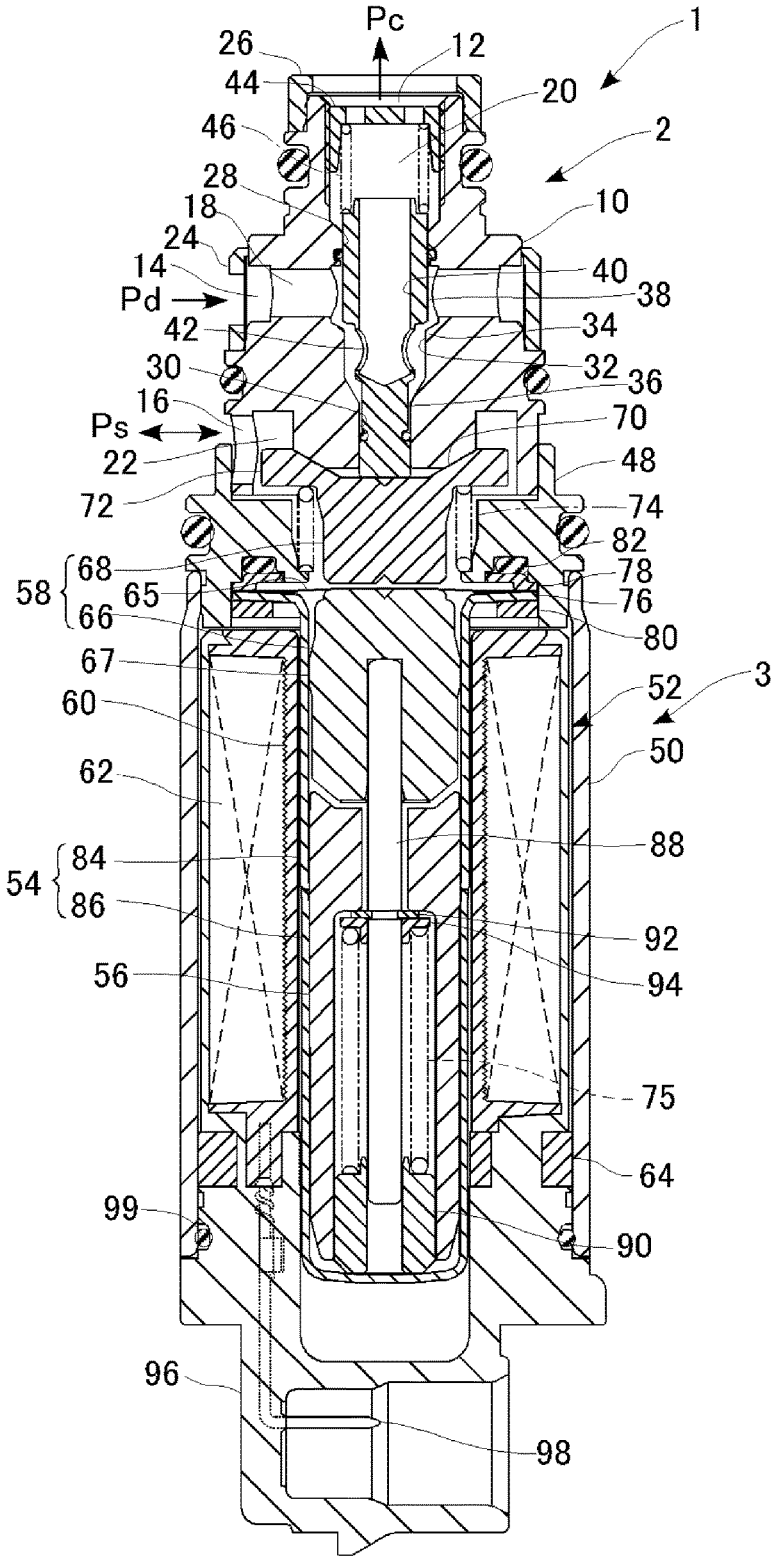
FIG. 1 is a cross-sectional view showing a structure of a control valve according to a first embodiment of the present invention.

FIG. 1 is a cross-sectional view showing a structure of a control valve according to a first embodiment of the present invention.

A control valve 1 according to the present embodiment is constituted as a control valve for controlling a not-shown variable displacement compressor (hereinafter referred to simply as "compressor") to be installed for a refrigeration cycle of an automotive air conditioner. This compressor discharges a high-temperature and high-pressure gas refrigerant produced by compressing a refrigerant flowing through the refrigeration cycle. The gas refrigerant is then condensed by a condenser (external heat-exchanger) and further adiabatically expanded by an expander so as to become a misty, low-temperature and low-pressure refrigerant. This low-temperature and low-pressure refrigerant is evaporated by an evaporator, and the evaporative latent heat cools the air of an interior of a vehicle. The refrigerant evaporated by the evaporator is again brought back to the compressor and thus circulates through the refrigeration cycle.

This compressor, which has a piston for compression coupled to a wobble plate, controls the refrigerant discharge rate by changing a stroke of the piston through changes in an angle of the wobble plate. The control valve 1 changes the angle of the wobble plate by controlling a flow rate of the refrigerant to be introduced from a discharge chamber to a crankcase of the compressor. For example, hydrochlorofluorocarbon (HFO-1234yf) or the like is used for the refrigerant; however, a refrigerant, such as carbon dioxide, whose working pressure is high may be used instead. In such a case, an external heat-exchanger such as a gas cooler may be placed in the refrigerant cycle, instead of the condenser.

The control valve 1 has a valve section in a refrigerant passage communicating between the discharge chamber and the crankcase of the compressor. And the control valve 1 is constituted as an electromagnetic valve for controlling the flow rate of refrigerant to be introduced from the discharge chamber to the crankcase of the compressor. An orifice, which causes the refrigerant inside the crankcase to be leaked into a suction chamber, and other components are also provided between the crankcase and the suction chamber but their drawings and detailed description are omitted here. The control valve 1 is constituted as a so-called Ps sensing valve that controls the flow rate of the refrigerant to be introduced from the discharge chamber to the crankcase so that a suction pressure Ps of the compressor can be maintained at a certain set pressure. The control valve 1 is constituted by integrally assembling a valve unit 2 and a solenoid 3. The valve unit 2 includes a body 5 of stepped cylindrical shape, a valve section disposed inside the body 10, and so forth.

The body 10 has a port 12 (which functions as a "crankcase communicating port"), a port 14 (which functions as a "discharge chamber communicating port"), and a port 16 (which functions as "suction chamber communicating port") in this order from top down. An internal space, where the port 14 is disposed, forms a discharge pressure chamber 18 into which a discharge pressure Pd is introduced. An internal space, where the port 12 is disposed, forms a crank pressure chamber 20 into which a crank pressure Pc is introduced. An internal space, where the port 16 is disposed, forms a suction pressure chamber 22 (corresponding to "pressure sensing chamber") into which the suction pressure Ps is introduced.

A strainer 24 is provided around the port 14. The strainer 24 is provided with a filter that suppresses the foreign material, such as metallic powders contained in a discharged refrigerant, from flowing into the discharge pressure chamber 18. Also, a strainer 26 is provided around the port 12. The strainer 26 is provided with a filter that suppresses the foreign material contained in the refrigerant of the crankcase from flowing into the crank pressure chamber 20.

The body 10 has a first guiding passage 28 joining the discharge pressure chamber 18 to the crank pressure chamber 20, a second guiding passage 30 joining the discharge pressure chamber 18 to the suction pressure chamber 22, and a valve hole 32 formed between the first guiding passage 28 and the second guiding passage 30, all of which are provided coaxially in a direction of axis line. A valve seat 34 is formed integrally with the body 10 in an opening end of the valve hole 32 at a discharge pressure chamber 18 side. An elongated actuating rod 36 is provided such that the actuating rod 36 penetrates the body 10 in the direction of axis line.

The actuating rod 36 is of a stepped cylindrical shape. One end side of the actuating rod 36 is slidably supported by the first guiding passage 28, whereas the other end side thereof is slidably supported by the second guiding passage 30. In other words, the actuating rod 36 is two-point supported by the body 10 at one end thereof and the other end thereof. A central part of the actuating rod 36 is formed integrally with a valve element 38 in the direction of axis line. The valve element 38 opens and closes the valve section by touching and leaving the valve seat 34 from the discharge pressure chamber 18 side. An internal passage 40 is formed in an upper half of the actuating rod 36, and a communicating hole 42 that communicates the inside and the outside of the actuating rod 36 is provided at a lower end portion of the internal passage 40. The refrigerant, which is led in from the port 14 and then passes through the valve section, is guided into the internal passage 40 through the communication hole 42 and is led out to the crank pressure chamber 20. A detailed description of the actuating rod 36 and its surround structures will be given later.

A spring support member 44 is screwed in an upper end opening of the body 10. And a spring 46 (functioning as a "biasing member") that biases the valve element 38 in a valve closing direction is set between the spring support member 44 and the actuating rod 36. The spring load of the spring 46 can be adjusted by a screwing amount of the spring support member 44 into the body 10.

The valve element 2 and the solenoid 3 are connected to each other via a cylindrical connecting member 48 made of a magnetic material. That is, a lower end of the body 10 is press-fitted in an upper end of the connecting member 48, and an upper end of a casing 50 of the solenoid 3 is press-fitted to a lower end of the connecting member 48. The port 16 is provided at a lower-end side wall of the body 10, and the suction pressure chamber 22 is formed in a space surrounded by the valve unit 2 and the solenoid 3.

On the other hand, the solenoid 3 is configured by including the casing 50, which functions as a yoke also, a molded coil 52 placed within the casing 50, a sleeve 54, which is a bottomed cylinder inserted into the molded coil 52 (the sleeve 54 functioning as a "housing"), a core 56, which is fixed within the sleeve 54, and a plunger 58, which is disposed in a position opposite to the core 56 in the direction of axis line. The molded coil 52 is configured by including a cylindrical bobbin 60 and an electromagnetic coil 62 wound around the bobbin 60. A ring-shaped plate 64 made of a magnetic material is molded at a lower end of the molded coil 52. This plate 64, together with the casing 50, constitutes a magnetic circuit. When the lower end of the casing 50 is swaged, the molded coil 52 is secured; when the upper end of the casing 50 is swaged, the casing 50 is secured to the connecting member 48. In the present embodiment, the body 10 and the casing 50 form a body for the whole control valve 1.

The plunger 58 is formed of two plungers divided with a filmy diaphragm 65 held between the two plungers. A first plunger 66, which is one of the two plungers, is placed inside the molded coil 52, and a second plunger 68, which is the other thereof, is placed in a space surrounded by the body 10 and the connecting member 48. The diaphragm 65 seals off an upper end opening of the sleeve 54 and thereby forms a reference pressure chamber in the sleeve 54. In the present embodiment, the reference pressure chamber is in a vacuum state but it may be filled with air, for instance. The diaphragm 65 is a pressure-sensing member with flexibility and is structured such that a plurality of polyimide films are stacked. In a modification, a metallic diaphragm may be used as the diaphragm 65.

A recess 70 is formed in a middle of a top surface of the second plunger 68. And a lower end surface of the actuating rod 36 is supported by a flat surface of the second plunger 68 in its central part so that the lower end surface of the actuating rod 36 can touch and leave the flat surface of the second plunger 68. Also, a flange portion 72 extending radially outward is provided in an upper end of the second plunger 68, and the arrangement is such that a lower surface of the flange portion 72 is disposed correspondingly counter to an upper surface of the connecting member 48. This arrangement generates a suction force in the direction of axis line between the flange portion 72 and the connecting member 48 when power is being supplied to the solenoid 3 and thereby enables the valve element 38 to rapidly move in a valve closing direction. The second plunger 68 is biased upward by a spring 74 ("biasing member") which is set between the lower surface of the flange portion 72 and a stepped portion formed inside the connecting member 48. The spring 74 has a spring force greater than that of the spring 46 that biases the valve element 38 in the valve closing direction.

An assembly is formed below the second plunger 68. In this assembly, the first plunger 66, the core 56, and a spring 75 are housed within the sleeve 54 and also an opening of the sleeve 54 is sealed off with the diaphragm 65. In other words, a flange portion 76 extending radially outward is provided in an upper end opening of the sleeve 54, and a ring-shaped plate 78 is jointed (outer-circumferentially welded) in such a manner as to hold an outer periphery of the diaphragm 65 in between the plate 78 and the flange portion 76. This assembly is secured to the connecting member 48 as well as the body 10, when an upper end of the assembly is inserted to a lower end opening of the connecting member 48 with the diaphragm 65 being assembled and then a ring-shaped member 80 is press-fitted from below. An O-ring 82 for sealing is set between a lower end surface of the connecting member 48 an the plate 78.

The molded coil 52 and the casing 50 made of a magnetic material are placed outside the sleeve 54. The sleeve 54, which is of a bottomed cylindrical shape, is constructed such that an upper half 84 made formed of a non-magnetic substance and a lower half 86 of a magnetic substance are welded together. Inside the sleeve 54, the core 56 is press-fitted at a lower half 86 side, and the first plunger 66 is placed at a upper half 84 side in such a manner that the first plunger 66 can be freely advanced and retreated in the direction of axis line.

The first plunger 66 is pressed-fitted to one end of a shaft 88 extending in the direction of axis line along the center of the core 56. The shaft 88 is positioned such that a position of one end of the shaft 88 in the direction of axis overlaps with a position of a sliding portion 67 in the direction of axis along the sleeve 54 in the first plunger 66. The other end of the shaft 88 is supported by a bearing member 90 placed inside the core 56. A retaining ring 92 is fitted at a midway point of the shaft 88, and a spring support 94 is provided so that an upper movement of the spring 75 is restricted by the retaining ring 92. The spring 75 by which to bias the first plunger 66 in a direction that biases it away from the core 56 via the shaft 88 is set between the spring support 94 and the bearing member 90. The spring load of the spring 75 can be adjusted in a manner such that the bottom of the sleeve 54 is pressed from outside and deformed during an assembling stage of the solenoid 3 and then the position of the bearing member 90 in the direction of axis line is varied.

In a lower end opening of the casing 50, a handle 96 is so provided as to seal the interior of the solenoid 3 from below. The handle 96 also functions as a connector portion through which one end of a terminal 98 leading to the electromagnetic coil 62 is exposed. The terminal 98 is connected to a not-shown external power supply. In order to prevent the foreign material from entering from outside, an O-ring 99 for sealing is provided between the handle 96 and the casing 50.

Figure 2:
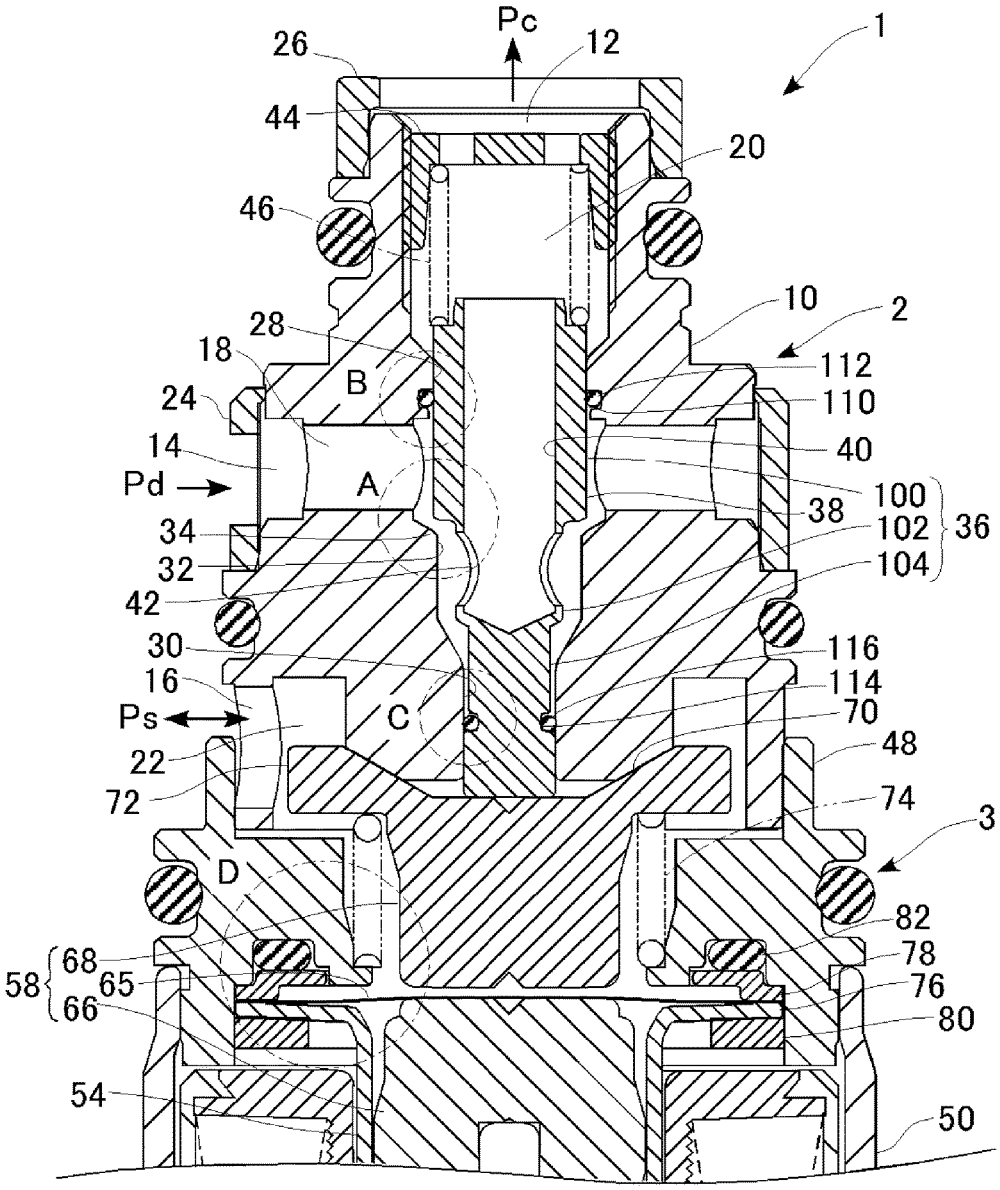
FIG. 2 is a partially enlarged sectional view of an upper half of FIG. 1.
Figure 3A:
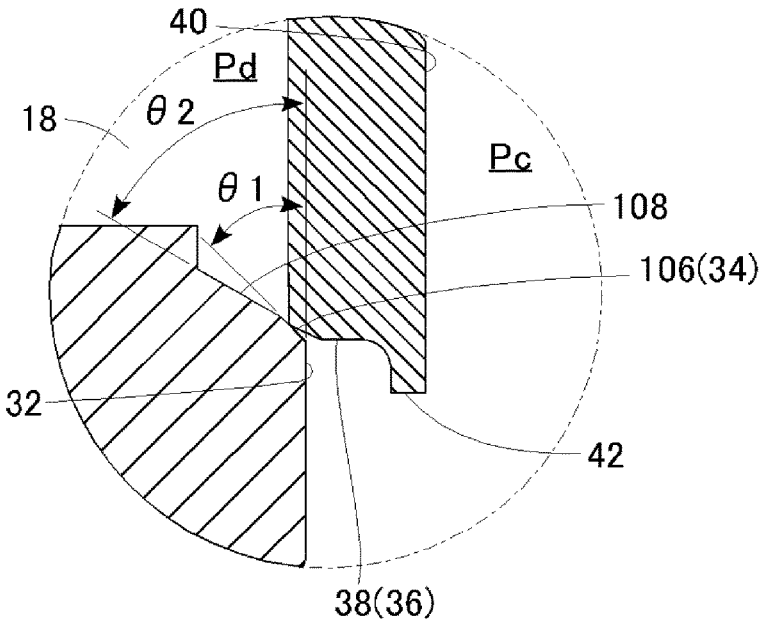
FIGS. 3A and 3B each shows a detail of a valve section.
Figure 3B:
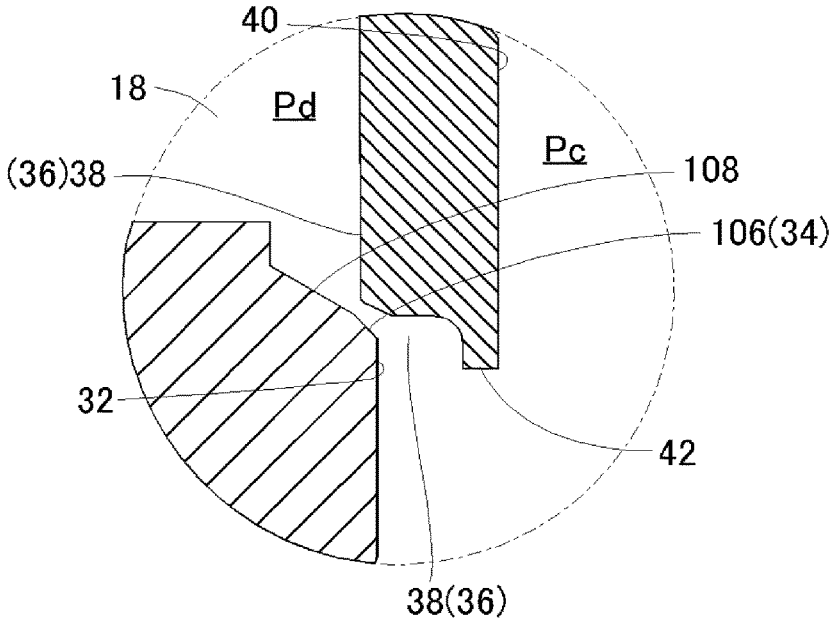
Figure 4A:
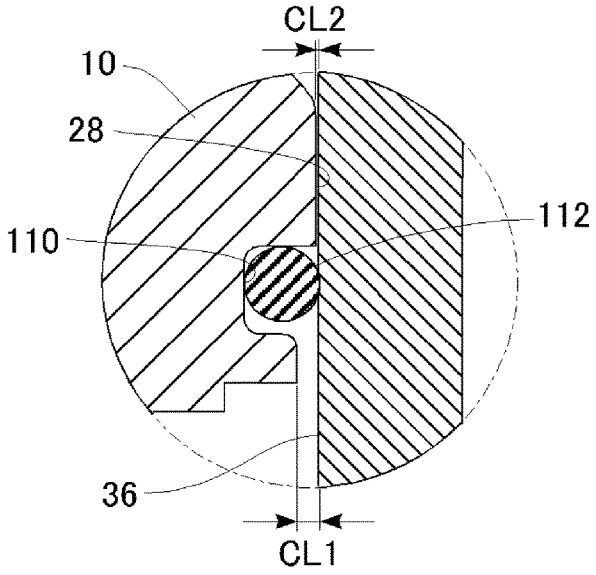
FIGS. 4A and 4B each shows a seal structure of a sliding portion.
Figure 4B:
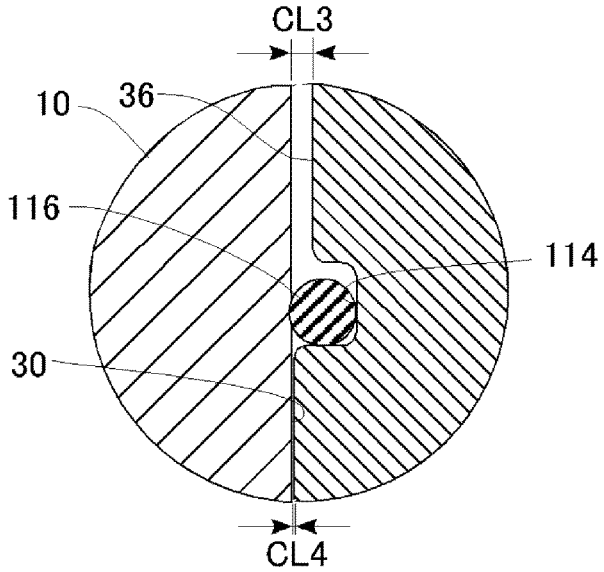
Figure 5:
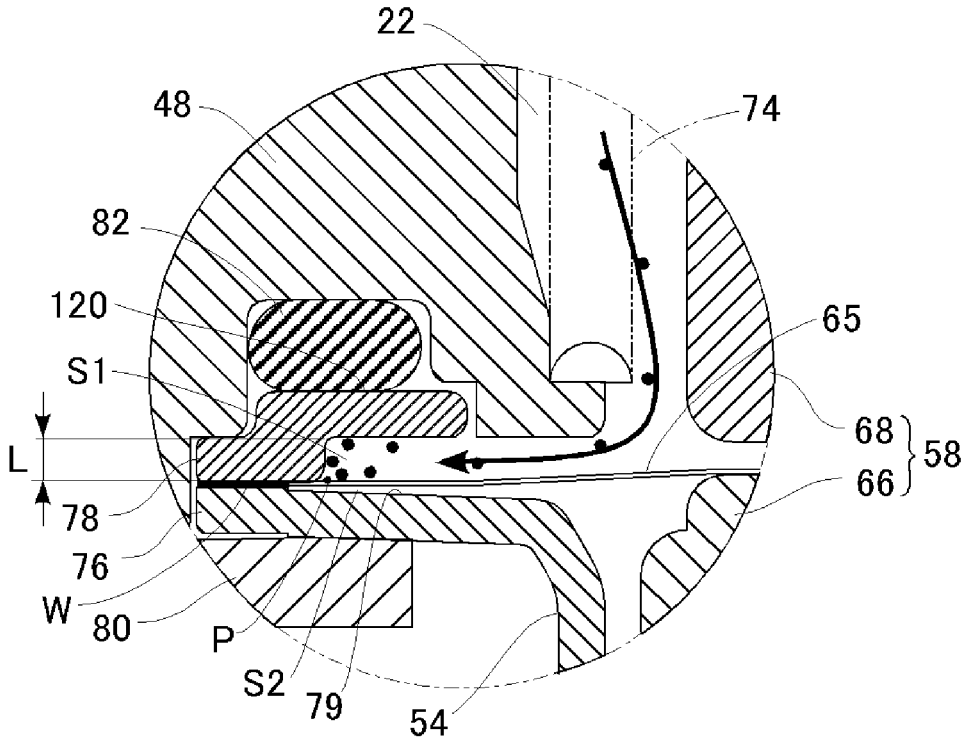
FIG. 5 shows a support structure of a diaphragm.

A detailed description is now given of major components of the control valve 1. FIG. 2 is a partially enlarged sectional view of an upper half of FIG. 1. FIGS. 3A and 3B each shows a detail of a valve section and are each an enlarged view of area marked with A in FIG. 2. FIG. 3A shows a valve-closed state of a valves section, and FIG. 3B shows a valve-opened state thereof. FIGS. 4A and 4B each shows a seal structure of a sliding portion. FIG. 4A is an enlarged view of area marked with B in FIG. 2, and FIG. 4B is an enlarged view of area marked with C in FIG. 2. FIG. 5 shows a support structure of a diaphragm and is an enlarged view of area marked with D in FIG. 2.

As shown in FIG. 2, the actuating rod 36, which is of a stepped cylindrical shape, has a larger-diameter part 100, a medium-diameter part 102, and a smaller-diameter part 104, from top to bottom. The larger-diameter part 100 is slidably supported by a first guiding passage 28, and the smaller-diameter part 104 is slidably supported by a second guiding passage 30. The medium-diameter part 102 penetrates the valve hole 32. Also, the communication hole 42 is formed in the medium-diameter part 102, and the internal passage 40 is so formed as to connect the interior of this medium-diameter part 102 to the interior of the larger-diameter part 100. The valve element 38 is formed integrally with a lower portion of the larger-diameter part 100.

In other words, the actuating rod 36 is stably supported at two points, namely through the first guiding passage 28 and the second guiding passage 30. Further, the structure is such that the valve element 38 is provided midway between the two points. This structure prevents or suppresses the valve element 28 from being tilted to the axis line of the valve hole 32, thereby seldom causing a hysteresis in the valve opening characteristics of the valve section. Also, this structure can prevent or suppress the leakage of refrigerant at the valve section due to the inclination of the valve element. As a result, the valve opening characteristics of the valve section can be satisfactorily maintained.

A passage joining the first guiding passage 28, the valve hole 32 and the second guiding passage 30 is formed in a stepped circular hole shape such that the inner diameter of the passage gets smaller in stages downwardly in accordance with the shape of the actuating rod 36. A tapered surface, whose diameter becomes larger upwardly, is formed in an upper end opening of the valve hole 32, and the valve seat 34 is formed on the tapered surface. A tapered surface, whose diameter becomes larger upwardly, is also formed in between the valve hole 32 and the second guiding passage 30.

As shown in FIGS. 3A and 3B, a first tapered surface 106, which functions as the valve seat 34, is provided in the opening end of the valve hole 32. And a second tapered surface 108 is further formed connectedly above the first tapered surface 106 and radially outward therefrom. The first tapered surface 106 has a first tilt angle θ1 relative to the direction of axis line. The second tapered surface 108 has a second tilt angle θ2, which is larger than a first tilt angle θ1 (i.e., θ2>θ1), relative to the direction of axis line.

In the present embodiment, it is assumed that the first tilt angle θ1 is set to 45 degrees and the second tilt angle θ2 is set to 60 degrees. However, the first tilt angle θ1 and the second tilt angle θ2 may be set to other angles so long as the first and second tilt angles are acute angles (θ1, θ2<90°) and formed such that the second tilt angle θ2 is larger than the first tilt angle θ1 (i.e., θ2>θ1). For example, the first tilt angle θ1 may be set within a range of 30 to 60 degrees (30°<θ2<60°) and the second tilt angle θ2 may be set within a range of 45 to 75 degrees (45°<θ2<75°). In the present embodiment, the surface of the valve element 38 opposite to the valve seat 34 is a tapered surface tilted 60 degrees relative to the direction of axis line. However, that which touches the valve seat 34 is an outer end (edge) of the valve element 38 and is not necessarily a tapered surface. For example, the surface of the valve element 38 opposite to the valve seat 34 may be vertical (90 degrees) to the direction of axis line.

In this manner, the seating characteristics of the valve element 38 can be satisfactorily maintained as shown in FIG. 3A by employing the structure where the valve seat 34 is of a tapered surface (first tapered surface 106). At the same time, provision of the second tapered surface 108 extending radially outward from and having a larger tilt angle than the first tapered surface 106 allows the valve opening degree to be sufficiently large at the time when the valve section is opened as shown in FIG. 3B and thereby ensures an appropriate flow rate of the refrigerant. That is, the edge of the valve element 38 is displaced to a position approximately equal to the height of the second tapered surface 108 at the time when the valve section is opened. In the present embodiment, the diaphragm 65 whose stroke is smaller than that of bellows or the like is used as the pressure-sensing member. Thus a great technical significance lies in the structure and its advantageous effects where the two-stage taper shape is used and an appropriate flow rate of the refrigerant is ensured.

Conceivable is a structure where the first tapered surface 106 only is provided without the formation of the second tapered surface 108. However, in such a structure having no second tapered surface 108, the flow rate of the refrigerant will change abruptly depending on the valve opening degree of the valve section, thereby making it difficult to obtain a desired flow rate. That is, taking the two-stage taper shape in the vicinity of the valve seat 34 as in the present embodiment allows the flow rate thereof to be maintained at a proper level and improves the seating characteristics of the valve element 38. In other words, setting each of tapered surfaces in plural stages to an optimum angle according to the flow characteristics achieves both the countermeasure for the leakage from the valve section and the maintenance of excellent controllability.

Refer back to FIG. 2. A first seal section 110 formed of an annular recessed groove is provided in a lower portion of the first guiding passage 28, and an O-ring 112 ("first sealing member") is fitted in the first seal section 110. The O-ring 112 seals off a gap between the actuating rod 36 and the first guiding passage 28 and restricts the leakage of the refrigerant from the discharge pressure chamber 18 to the crank pressure chamber 20. A second seal section 114 formed of an annular recessed groove is provided in the smaller-diameter part 104 of the actuating rod 36, and an O-ring 116 ("second sealing member") is fitted in the second seal section 114. The O-ring 116 seals off a gap between the actuating rod 36 and the second guiding passage 30 and restricts the leakage of the refrigerant from the discharge pressure chamber 18 to the suction pressure chamber 22.

As shown in FIG. 4A, the first seal section 110 contains the O-ring 112. In consideration of the ability to assemble the first seal section 110 and the O-ring 112, the width of the first seal section 110 in the direction of axis line is slightly larger than the size of the O-ring 112. In portions where gaps are formed between the actuating rod 36 and the first guiding passage 28 and also these gaps are formed between a high-pressure side and a low-pressure side, a high-pressure-side clearance CL1 on a discharge pressure chamber 18 side of the first seal section 110 is larger than a low-pressure-side clearance CL2 on a crank pressure chamber 20 side thereof. In the present embodiment, the high-pressure-side clearance CL1 is set larger than the width of each mesh in the filter of the strainer 24. The low-pressure-side clearance CL2 is set smaller than the width of each mesh in the filter of the strainer 24.

As shown in FIG. 4B, the second seal section 114 contains the O-ring 116. Similarly, in consideration of the ability to assemble the second seal section 114 and the O-ring 116, the width of the second seal section 114 in the direction of axis line is slightly larger than the size of the O-ring 116. In portions where gaps are formed between the actuating rod 36 and the second guiding passage 30 and also these gaps are formed between a high-pressure side and a low-pressure side, a high-pressure-side clearance CL3 on a discharge pressure chamber 18 side of the second seal section 114 is larger than a low-pressure-side clearance CL4 on a suction pressure chamber 22 side thereof. In the present embodiment, the high-pressure-side clearance CL3 is set larger than the width of each mesh in the filter of the strainer 24. The low-pressure-side clearance CL4 is set smaller than the width of each mesh in the filter of the strainer 24.

In the structure as described above, each O-ring is arranged in each seal section and thereby the O-ring is so pressed as to close the low-pressure-side clearance due to a pressure difference between the high-pressure side and the low-pressure side. Also, the low-pressure-side clearance is relative small. This can prevent the problem of an increased sliding friction caused by the O-ring 112 stuck in the low-pressure-side clearance even if the O-ring 112 has been deformed. At the same time, the high-pressure-side clearance is relatively large; if foreign material enters from the high pressure side, the occurrence of the foreign material being entangled can be prevented or suppressed. As a result, the smooth operation of the actuating rod 36 as well as the valve element 38 can be maintained. With the provision of the filter, the size of foreign material ever entering the body 10 is primarily limited to a sufficiently small size relative to the high-pressure-side clearance. Also, the amount of foreign material flowing into between a space between the actuating rod 36 and the first guiding passage 28 and the amount of foreign material flowing into between a space between the actuating rod 36 and the second guiding passage 30 are suppressed. As a result, the occurrence of the foreign material being entangled there is less likely to occur.

Refer back to FIG. 2. The diaphragm 65 is supported such that the outer periphery of the diaphragm 65 is held between the flange portion 76 of the sleeve 54 and the plate 78. And the flange portion 76 and the plate 78 are further held between a lower side of the connecting member 48 and the ring-shaped member 80. When the diaphragm 65 senses the suction pressure Ps on a side thereof opposite to the reference pressure chamber, the diaphragm 65 develops a displacement with the outer periphery thereof as a supporting point and thereby a valve-opening-direction or valve-closing-direction drive force is supplied to the plunger 58.

Since the diaphragm 65 is located near the solenoid 3, foreign material such as metallic powers contained in the refrigerant tends to be pulled by its magnetic attractive force. As a result, a local damage may possibly be caused by the repeated stress for each activation of the solenoid 3 if foreign material is caught near the supporting point of the diaphragm 65. In the light of this problem, a supporting structure near the supporting point of the diaphragm is devised using a novel and inventive structure as follows.

That is, as shown in FIG. 5, in a position where a supporting point P is located slightly inward than a welded part W of the diaphragm 65 (i.e., the welded part W being a joint part of the flange portion 76 and the plate 78 with the diaphragm 65 disposed between the flange portion 76 and the plate 78), the plate 78 is formed such that, in the position of the supporting point P and inward from this position thereof, a space 51 on a plate 78 side is larger than a space S2 on a sleeve 54 side. More specifically, the plate 78 has a stepped portion 120, which is bent or curved toward the connecting member 48 slightly outward from the supporting point P, wherein a part of the stepped portion 120 disposed counter to the supporting point P and an internal part of the stepped portion 120 are spaced apart from the diaphragm 65. A distance L between the stepped portion 120 and the diaphragm 65 is a greater than or equal to the thickness of the plate 78; the distance L is sufficiently larger than the size of foreign material anticipated to enter. The space 51 is sufficiently large in a position where the diaphragm develops a displacement. Thus, in the event that foreign materials (see blacked-out circles in FIG. 5) enter one surface side of the diaphragm 65 as indicated by an arrow in FIG. 5, a situation where these foreign materials are held between the plate 78 and the diaphragm 65 so as to generate a local stress can be prevented. Also, a part of the diaphragm 65 positioned inwardly from the supporting point P of the diaphragm 65 will not come in contact with the stepped portion 120 during a displacement process. Note that the stepped portion 120 also functions as a clamping part so that the O-ring 82 can be sandwiched between the connecting member 48 and the stepped portion 120.

Also, the sleeve 54 has a tapered surface 79 in the flange portion 76. This tapered surface 79 is formed such that it is spaced apart gradually from the diaphragm 65 starting at a periphery (near the inner end of the welded part W) of the diaphragm 65 and such that an inner corner of the tapered surface 79 is of a round shape and therefore is rounded. A part of the diaphragm 65 positioned inwardly from the supporting point P may come in contact with the flange portion 76 during a displacement process. However, since the flange portion 76 is so formed as to have the tapered surface 79 and be of a round shape, the occurrence of the local stress is prevented. Also, although the space S2 between the tapered surface 79 of the sleeve 54 and the diaphragm 65 is smaller than the space S1 between the plate 78 and the diaphragm 65, an opening end of the sleeve 54 is sealed by the diaphragm 65 and therefore no foreign material will enter the space S2. Accordingly, the durability of the diaphragm 65 can be maintained high.

Although, in the present embodiment, the starting point (the starting point of an R shape) of the stepped portion 120 in the plate 78 is set outwardly from the supporting point P, the starting point thereof may be set to the position of the supporting point P instead. Since the supporting point P itself in the diaphragm 65 does not develop a displacement, the foreign material being entangled can be prevented or suppressed even if the supporting point P agrees with the starting point of the stepped portion 120.

Figure 6:
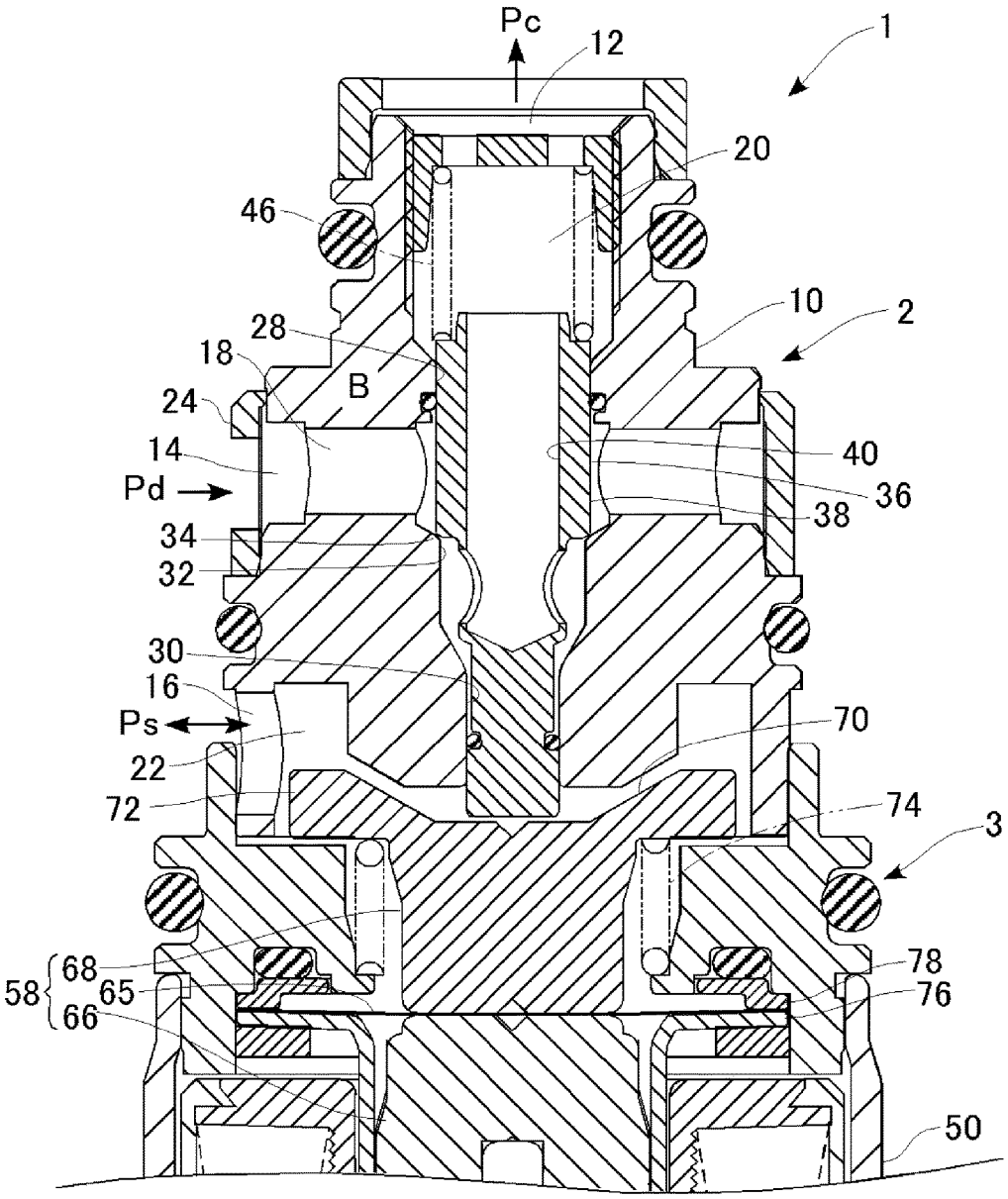
FIG. 6 shows an operational process of a control valve.
Figure 7:
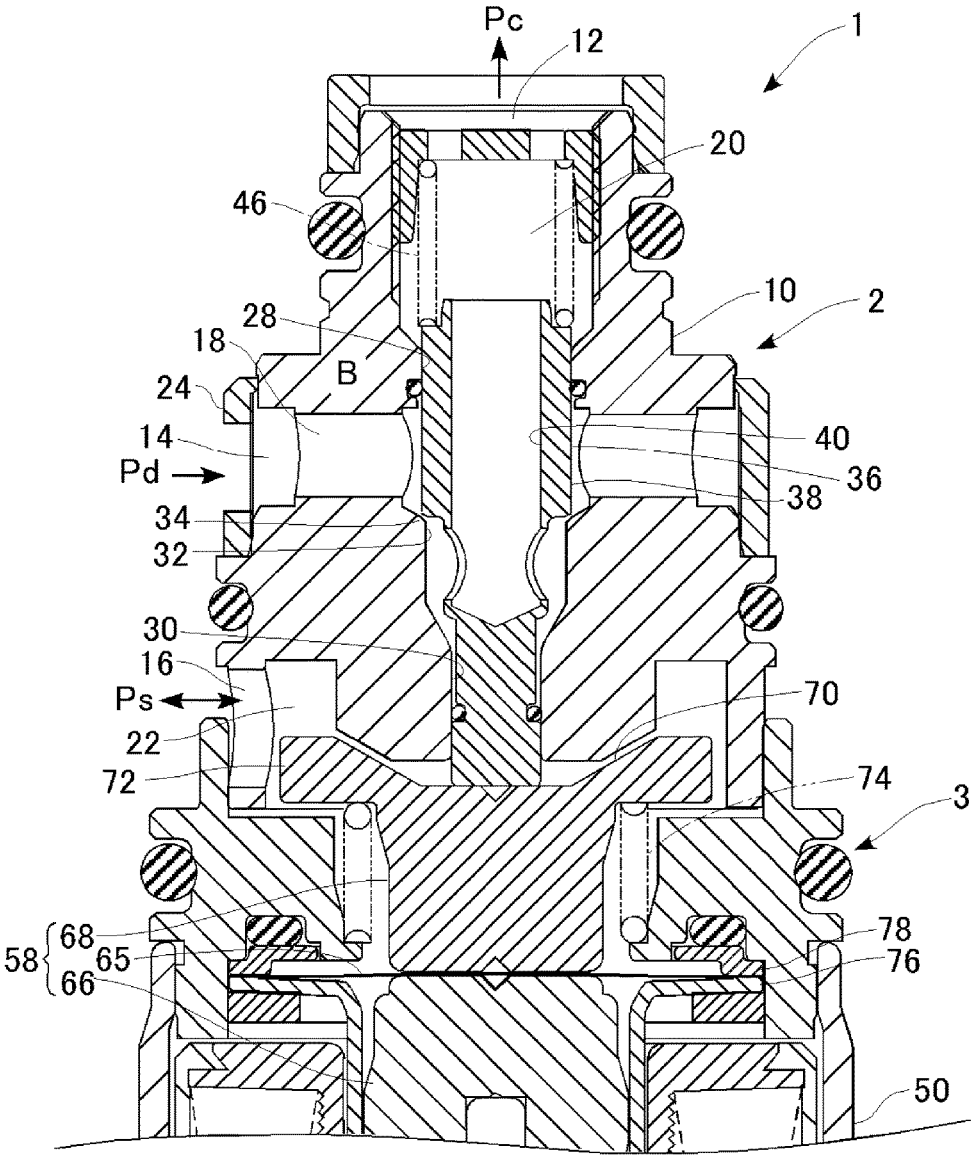
FIG. 7 shows an operational process of a control valve.

Now, an operation of the control valve 1 will be explained. FIG. 6 and FIG. 7 each shows an operational process of the control valve. FIG. 6 shows a state where the control valve operates with the maximum capacity. FIG. 7 shows a relatively stable control state. FIG. 2, already described above, shows a state where the control valve operates with the minimum capacity. A description is given hereinbelow based on FIG. 1 with reference to FIG. 2, FIG. 6 and FIG. 7, as appropriate.

While the solenoid 3 is not electrically conducting, namely while the automotive air conditioner is not operating, no suction force between the core 56 and the plunder 58 is in effect in the control valve 1. Also, since the suction pressure Ps is high, the first plunger 66 in contact with the diaphragm 65 is displaced downward resisting the spring load of the spring 75. At the same time, since, as shown in FIG. 2, the second plunger 68 is biased upward by the spring 74 in such a manner as to be away from the first plunger 66, the second plunger 68 biases the valve element 38 to a fully opened position via the actuating rod 36. At this time, the refrigerant, at the discharge pressure Pd, introduced to the port 14 from the discharge chamber of the compressor will pass through the fully opened valve section and flow into the crankcase from the port 12.

On the other hand, when a maximum control current is supplied to the electromagnetic coil 62 of the solenoid 3 at the startup or the like of the automotive air conditioner, the first plunger 66 attracts the second plunger 68 via the diaphragm 65 resisting the biasing force of the spring 74. Accordingly, as shown in FIG. 6, the second plunger 68 is attracted and comes in contact with the diaphragm 65 and thereby is moved downward. As a result, the valve element 38 is pressed down by the spring 46 and this causes the valve element 38 to touch the valve seat 34, which in turn makes the valve section fully closed. At this time, the actuating rod 36 is in a state where it is spaced apart from the second plunger 68.

As, in this manner, the suction pressure Ps of the suction chamber becomes sufficiently low, the diaphragm 65 senses the suction pressure Ps and is displaced upward and then the second plunger 68 comes in contact with the actuating rod 36, as illustrated in FIG. 7. If, at this time, the control current supplied to the electromagnetic coil 62 of the solenoid 3 is lowered according to a preset temperature of the air conditioner, the second plunger 68 and the first plunger 66, which are attracted to each other and in contact with each other via the diaphragm 65, will be moved upward, together in an integrated manner, to a position where the suction pressure Ps, the spring loads of the springs 46, 74 and 75, and the suction force of the solenoid 3 are balanced. As a result, the valve element 38 is lifted by the second plunger 68 and is separated from the valve seat 34 and the valve opening degree thereof is set to a predetermined level. Thus the flow rate of the refrigerant at the discharge pressure Pd is controlled at a flow rate according to the valve opening degree and then introduced into the crankcase. Also, the compressor transits to an operation at a capacity corresponding to the control current.

If the control current supplied to the electromagnetic coil 62 of the solenoid 3 is constant, the diaphragm 65 will sense the suction pressure Ps and control the valve opening degree. If, for example, the refrigeration load becomes large and the suction pressure Ps becomes high, the valve element 38 together with the actuating rod 36, the second plunger 68, the diaphragm 65 and the first plunger 66 will be displaced downward together in an integrated manner. As a result, the valve opening degree becomes small and therefore the compressor operates in a such manner as to increase the discharging capacity. As a result, the suction pressure Ps drops and is brought close to the set pressure. Conversely, as the refrigeration load becomes small and the suction pressure Ps becomes low, the valve element 38 will be displaced upward. As a result, the valve opening degree becomes large and therefore the compressor operates in such a manner as to decrease the discharging capacity. As a result, the suction pressure Ps rises and is brought close to the set pressure. In this manner, the control valve 1 controls the discharging capacity of the compressor so that the suction pressure Ps can be a set pressure set by the solenoid 3.

Second Embodiment

Figure 8:
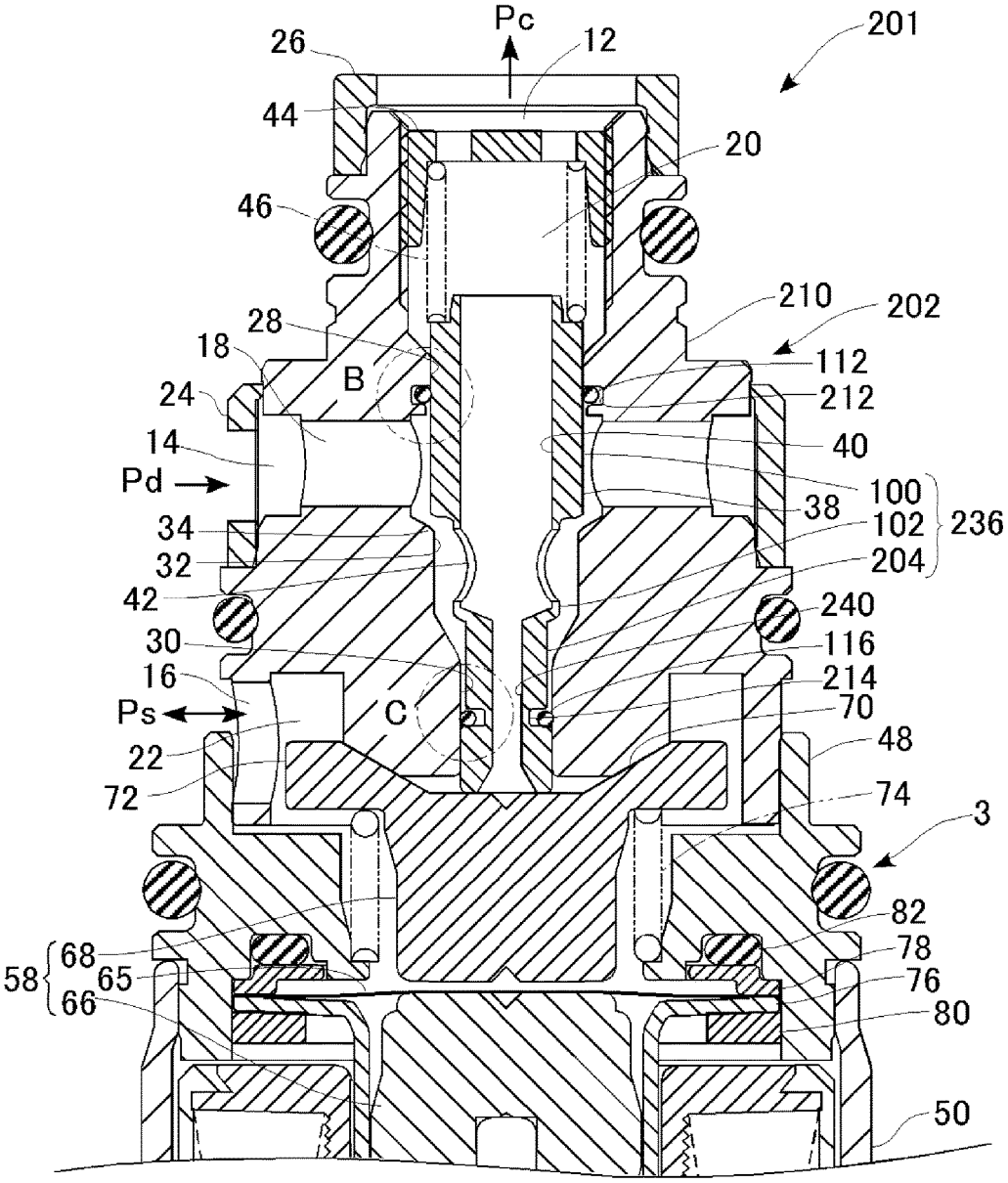
FIG. 8 is a partially enlarged sectional view of an upper half a control valve according to a second embodiment of the present invention.
Figure 9A:
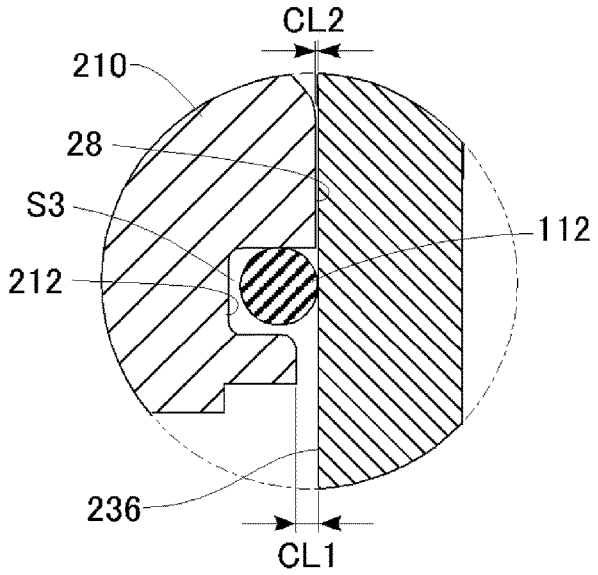
FIGS. 9A and 9B each shows a seal structure of a sliding portion.
Figure 9B:
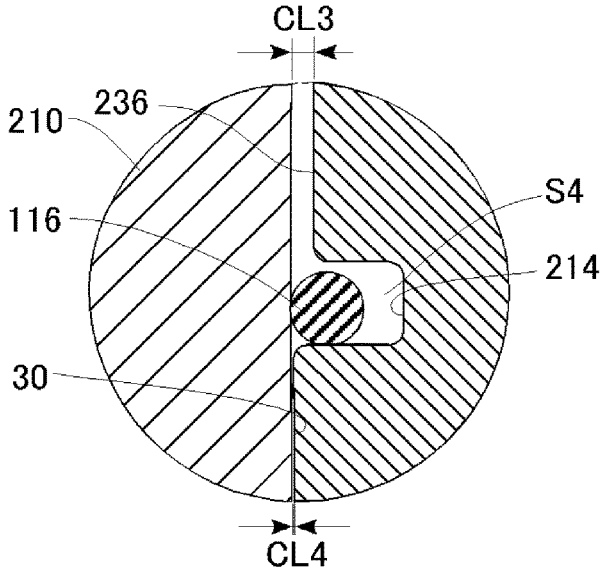
Figure 10:
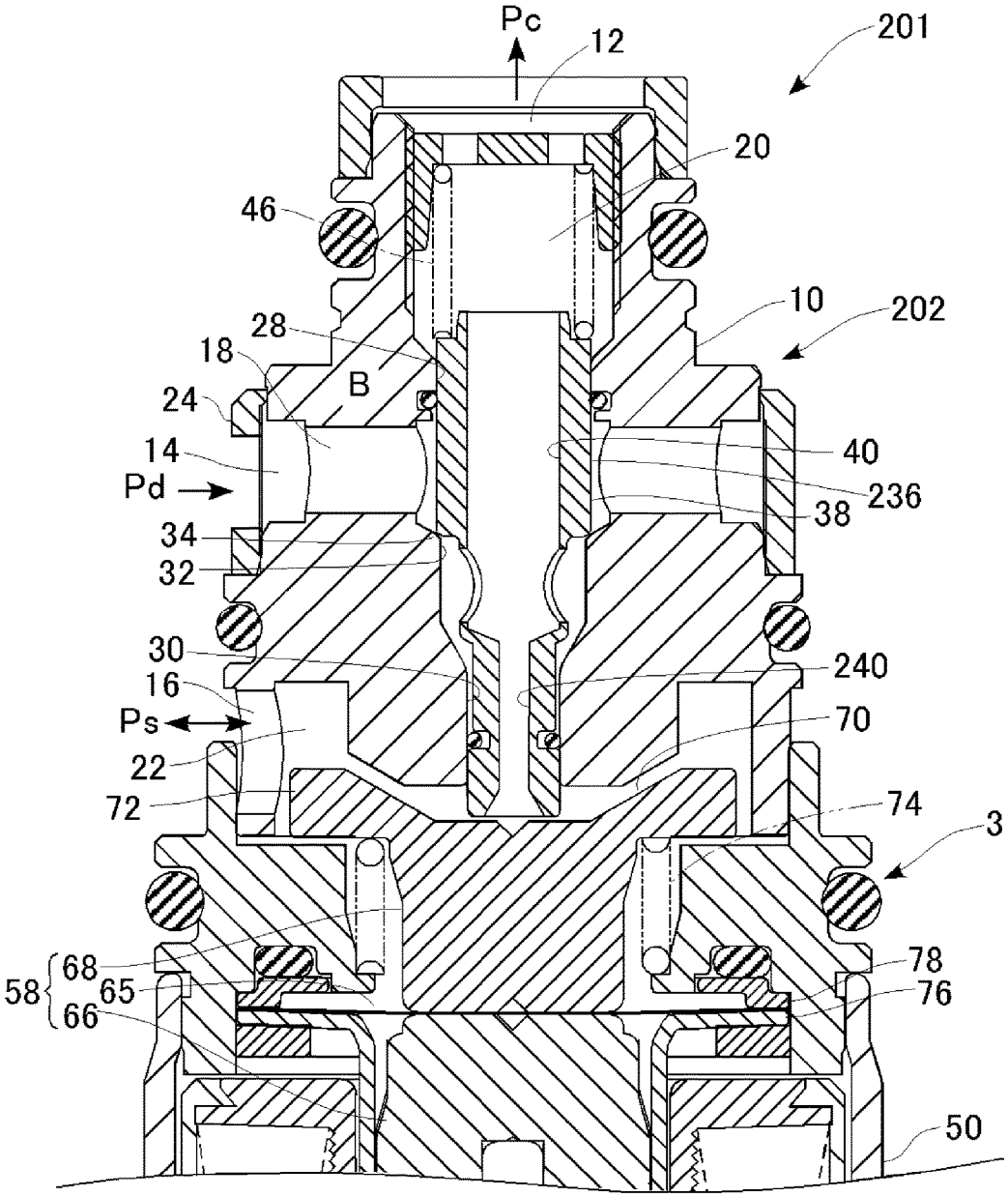
FIG. 10 shows an operational process of a control valve.

A description is now given of a second embodiment of the present invention. A control valve according to the second embodiment shares many common features with the first embodiment except for the structure and arrangement of a body and a valve driven member. Thus, the structural components of the second embodiment closely similar to those of the first embodiment are given the identical reference numerals and the description thereof is omitted as appropriate. FIG. 8 is a partially enlarged sectional view of an upper half the control valve according to the second embodiment of the present invention. FIGS. 9A and 9B each shows a seal structure of a sliding portion. FIG. 9A is an enlarged view of area marked with B in FIG. 8, and FIG. 9B is an enlarged view of area marked with C in FIG. 8. FIG. 10 shows an operational process of a control valve and shows a state where a bleed function of the control valve is performed. FIG. 8 shows a state where the control valve operates with the minimum capacity.

As shown in FIG. 8, a control valve 201 is constituted by integrally assembling a valve unit 202 and a solenoid 3. An internal bleed passage 40 is formed in a smaller-diameter part 204 of an actuating rod 236. The internal passages 40 and 240 form a communicating path that runs through the actuating rod 236 in the direction of axis line. In FIG. 8, the second plunger 68 is in contact with the actuating rod 236 and thereby seals the lower end opening of the actuating rod 236, so that the communication between the crank pressure chamber 20 and the suction pressure chamber 22 is shut off. When, however, the second plunger 68 gets spaced apart from (leaves) the actuating rod 236, the delivering of the refrigerant from the crank pressure chamber 20 to the suction pressure chamber 22 by way of the communicating path is permitted.

As shown in FIG. 9A, a first seal section 212 according to the second embodiment is provided such that a recessed groove of the first seal section 212 is larger in depth than that of the first seal section 110 according to the first embodiment. Also, the first seal section 212 is structured such that a space S3 is formed between an underside of the recessed groove thereof and the O-ring 112. Thus, even though the O-ring 112 is compressed axially by the pressure difference between a high pressure side and low pressure side of the first seal section 212 and thereby becomes larger in size radially outward, the O-ring 112 is less likely to be subjected to the reaction force from a bottom surface of the first seal section 212. This structure prevents the sliding friction between the O-ring 112 and the actuating rod 236 from becoming excessively large, so that the smooth operation of the actuating rod 236 as well as the valve element 38 is maintained.

Similar to the first seal section 212, a second seal section 214 according to the second embodiment is provided such that a recessed groove of the second seal section 214 is larger in depth than that of the second seal section 114 according to the first embodiment. Also, the second seal section 214 is structured such that a space S4 is formed between an underside of the recessed groove thereof and the O-ring 114. Thus, even though the O-ring 116 is compressed axially by the pressure difference between a high pressure side and low pressure side of the second seal section 214 and thereby becomes larger in size radially outward, the O-ring 116 is less likely to be subjected to the reaction force from a bottom surface of the second seal section 214. This structure prevents the sliding friction between the O-ring 116 and the body 210 from becoming excessively large, so that the smooth operation of the actuating rod 236 as well as the valve element 38 is maintained.

As structured above, the second plunger 68 gets temporarily spaced apart from (leaves) the actuation rod 236, as shown in FIG. 10, by the suction force of the solenoid 3, when the maximum control current is supplied to the solenoid 3 at the startup or the like of the automotive air conditioner. Accordingly, the crank pressure chamber 20 and the suction pressure chamber 22 now communicate with each other. As a result, the refrigerant in the crankcase passes through the crank pressure chamber 20, the internal passages 40 and 240 and the suction pressure chamber 22, and is then delivered to a suction chamber side from the port 16. That is, the passage from the discharge chamber to the crankcase is shut off and the refrigerant in the crankcase is released by way of not only an orifice but also the control valve 201. Hence, the compressor can promptly shift its operation mode to a maximum-capacity operation. In the second embodiment, a mechanism and structure in which the second plunger 68 comes in contact with (touches) and gets spaced apart from (leaves) the actuating rod 236 as described above constitutes a "gating mechanism".

The description of the present invention given above is based upon illustrative embodiments. These embodiments are intended to be illustrative only and it will be obvious to those skilled in the art that various modifications could be further developed within the technical idea underlying the present invention and that such additional modifications are also within the scope of the present invention.

In the above embodiment, a structure where a space is provided in a radial direction of the O-ring (sealing member) is used for a type having a bleed structure as shown in FIG. 8. In a modification, a structure where a space is provided in a radial direction of the O-ring (sealing member) may be similarly used for a type having no bleed structure as shown in FIG. 2.

In the above embodiment, an example such as one shown in FIG. 2 is described where the first seal section is provided in the body and the second seal section is provided in the actuating rod. In a modification, the first seal section and the second seal section may both be provided in the body. Or alternatively, the first seal section and the second seal section may both be provided in the actuating rod. Or still alternatively, the first seal section may be provided in the actuation rod, whereas the second seal section may be provided in the body.

In the above embodiment, the diaphragm 65 used as the pressure-sensing member is structured such that a plurality of polyimide films are stacked. However, this should not be considered as limiting and, for example, the diaphragm 65 may be formed of another resin material or a sheet metal such as beryllium copper or stainless steel.

In the above embodiment, an example is described where the control valve is constituted as a so-called Ps sensing valve that controls the discharging capacity so that the suction pressure Ps of the variable displacement compressor can be maintained at a certain set pressure. However, the method for controlling the control valve and one which is to be controlled by this control valve according to the embodiments of the present invention are not limited to those as described above. For example, the control valve may be constituted as a so-called Pc sensing valve that controls the discharging capacity so that the crank pressure Pc is introduced from the port 16 and then the crank pressure Pc can be maintained at a certain set pressure.

In the above embodiment, an example is described where the control valve is constituted as a control valve that controls the flow rate of the refrigerant introduced from the discharge chamber to the crankcase of the variable displacement compressor. However this should not be considered as limiting and, for example, the control valve may be constituted as a control valve that controls the flow rate of the refrigerant introduced from the crankcase to the suction chamber.

In the above embodiment, an example is described where a plunger-divided type is used as the solenoid 3 but a solenoid constructed of a single plunger may be used instead. In such a case, the pressure sensing section may be provided between the actuating rod and the plunger or may be provided opposite to the plunger.

In the above embodiment, an example is described where the control valve controls the flow of the refrigerant as a working fluid but the control valve may be an electromagnetic valve that controls the flow of a working fluid other than the refrigerant.

While the preferred embodiments of the present invention have been described using specific terms, such description is for illustrative purposes only, and it is to be understood that changes and variations may be made without departing from the spirit or scope of the appended claims.

What is claimed is:

1. A control valve for a variable displacement compressor for varying a discharging capacity of the variable displacement compressor by controlling a flow rate of refrigerant to be introduced from a discharge chamber of the compressor to a crankcase of the compressor, the control valve comprising:

a body having a discharge pressure chamber that communicates with the discharge chamber, a crank pressure chamber that communicates with the crankcase, a valve hole provided in a passage joining the discharge pressure chamber to the crank pressure chamber, and a guiding passage formed coaxially with the valve hole;

an actuating rod slidably supported along the guiding passage, the actuating rod having a valve element configured to open and close a valve section such that the valve element touches and leaves the valve hole;

a solenoid configured to apply force in an opening or closing direction of the valve section to the valve element via the actuating rod; and a seal section provided between the actuating rod and the guiding passage, the seal section containing a sealing member therein where the sealing member serves to restrict leakage of the refrigerant from a high pressure side to a low pressure side, wherein the seal section is an annular recessed groove formed in either one of an inner surface of the guiding passage into which the actuating rod is inserted and an outer surface of the actuating rod that is inserted into the guiding passage, wherein the sealing member is an annular member fitted in the recessed groove in such a manner that the sealing member is supported by either one of the body and the actuating rod and is in contact with and slidable relative to an other one of the body and the actuating rod, wherein the recessed groove has a width in an axial direction larger than a width in the axial direction of a cross section of the sealing member, so that a space is present between a higher-pressure-side surface of the recessed groove and the sealing member, wherein the actuating rod and the guiding passage are configured such that a clearance, between the actuating rod and the guiding passage, which is at a higher-pressure side adjacent the recessed groove is larger than a clearance therebetween which is at a lower-pressure side adjacent the recessed groove, and wherein a clearance length in the axial direction on the higher-pressure side of the recessed groove is shorter than a clearance length in the axial direction on the lower-pressure side of the recessed groove.

2. A control valve, for a variable displacement compressor, according to claim 1, further comprising a filter configured to restrict entry of foreign particles contained in the refrigerant when the refrigerant is introduced from the discharge chamber to the discharge pressure chamber, wherein the clearance therebetween, which is on the higher-pressure side of the seal section, is larger than a width of each mesh in the filter.

3. A control valve, for a variable displacement compressor, according to claim 1, wherein the clearance at the lower-pressure side adjacent the recessed groove is sized such that the sealing member being deformed owing to a pressure difference between the higher-pressure side and the lower-pressure side is not stuck in the clearance at the lower-pressure side.

4. A control valve, for a variable displacement compressor, according to claim 3, further comprising a filter that prevents entry of foreign materials contained in the refrigerant introduced from the discharge chamber to the discharge pressure chamber, wherein the clearance at the lower-pressure side is smaller than a width of a mesh of the filter.

5. A control valve for a variable displacement compressor for varying a discharging capacity of the variable displacement compressor by controlling a flow rate of refrigerant to be introduced from a discharge chamber of the compressor to a crankcase of the compressor, the control valve comprising:

a body having a discharge pressure chamber that communicates with the discharge chamber, a crank pressure chamber that communicates with the crankcase, a valve hole provided in a passage joining the discharge pressure chamber to the crank pressure chamber, and a guiding passage formed coaxially with the valve hole;

an actuating rod slidably supported along the guiding passage, the actuating rod having a valve element configured to open and close a valve section such that the valve element touches and leaves the valve hole;

a solenoid configured to apply force in an opening or closing direction of the valve section to the valve element via the actuating rod; and a seal section provided between the actuating rod and the guiding passage, the seal section containing a sealing member therein where the sealing member serves to restrict leakage of the refrigerant from a high pressure side to a low pressure side, wherein the seal section is an annular recessed groove formed in either one of an inner surface of the guiding passage into which the actuating rod is inserted and an outer surface of the actuating rod that is inserted into the guiding passage, wherein the sealing member is an annular member fitted in the recessed groove in such a manner that the sealing member is supported by either one of the body and the actuating rod and is in contact with and slidable relative to an other one of the body and the actuating rod, and wherein the actuating rod and the guiding passage are configured such that a clearance, between the actuating rod and the guiding passage, which is at a higher-pressure side adjacent the recessed groove is larger than a clearance therebetween which is at a lower-pressure side adjacent the recessed groove;

wherein the guiding passage connects the discharge pressure chamber to the crank pressure chamber, wherein the seal section contains the sealing member therein where the sealing member serves to restrict the leakage of the refrigerant from the discharge pressure chamber to the crank pressure chamber, and wherein the actuating rod and the guiding passage are configured such that the higher-pressure-side clearance at a discharge pressure chamber side of the seal section, between the actuating rod and the guiding passage, is larger than the lower-pressure-side clearance at a crank pressure chamber side thereof therebetween.

6. A control valve for a variable displacement compressor for varying a discharging capacity of the variable displacement compressor by controlling a flow rate of refrigerant to be introduced from a discharge chamber to a crankcase of the compressor, the control valve comprising:

a body having a discharge pressure chamber that communicates with the discharge chamber, a crank pressure chamber that communicates with the crankcase, a valve hole provided in a passage joining the discharge pressure chamber to the crank pressure chamber, and a guiding passage formed coaxially with the valve hole;

an actuating rod slidably supported along the guiding passage, the actuating rod having a valve element configured to open and close a valve section such that the valve element touches and leaves the valve hole;

a solenoid configured to apply force in an opening or closing direction of the valve section to the valve element via the actuating rod; and a seal section provided between the actuating rod and the guiding passage, the seal section containing a sealing member therein where the sealing member serves to restrict leakage of the refrigerant from a high pressure side to a low pressure side, wherein the actuating rod and the guiding passage are configured such that a clearance, between the actuating rod and the guiding passage, which is at a higher-pressure side of the seal section is larger than a clearance therebetween which is at a lower-pressure side of the seal section, wherein the guiding passage connects the discharge pressure chamber to the crank pressure chamber, wherein the seal section contains the sealing member therein where the sealing member serves to restrict the leakage of the refrigerant from the discharge pressure chamber to the crank pressure chamber, and wherein the actuating rod and the guiding passage are configured such that the higher-pressure-side clearance at a discharge pressure chamber side of the seal section, between the actuating rod and the guiding passage, is larger than the lower-pressure-side clearance at a crank pressure chamber side thereof therebetween, wherein the body includes a pressure sensing chamber to which a pressure to be sensed is introduced, a first guiding passage connecting the discharge pressure chamber to the crank pressure chamber and a second guiding passage connecting the discharge pressure chamber to the pressure sensing chamber, as the guiding passage, and the valve hole formed between the first guiding passage and the second guiding passage, wherein the actuating rod is configured such that one end side of the actuating rod is slidably supported along the first guiding passage and an other end side thereof is slidably supported along the second guiding passage, the actuating rod is provided with the valve element disposed in a middle of the actuating rod, and an internal passage through which the discharge pressure chamber and the crank pressure chamber are communicated when the valve section is opened is formed in the actuating rod, the control valve further comprising a pressure-sensing section configured to sense a suction pressure of a suction chamber or a crank pressure of the crankcase as the pressure to be sensed and configured to exert a valve-opening-direction force on the valve element via the actuating rod when the pressure to be sensed is lower than a set pressure, wherein the solenoid applies the valve-opening-direction force according to the set pressure to the valve element via the actuating rod, wherein, as the seal section, a first seal section, provided between the actuating rod and the first guiding passage, contains a first sealing member therein where the first sealing member serves to restrict the leakage of the refrigerant from the discharge pressure chamber to the crank pressure chamber, wherein, as the seal section, a second seal section, provided between the actuating rod and the second guiding passage, contains a second sealing member therein where the second sealing member serves to restrict the leakage of the refrigerant from the discharge pressure chamber to the pressure sensing chamber, wherein the actuating rod and the first guiding passage are configured such that the higher-pressure-side clearance at a discharge pressure chamber side of the first seal section, between the actuating rod and the first guiding passage, is larger than the lower-pressure-side clearance at a crank pressure chamber side thereof therebetween, and wherein the actuating rod and the second guiding passage are configured such that the higher-pressure-side clearance at a discharge pressure chamber side of the second seal section, between the actuating rod and the second guiding passage, is larger than the lower-pressure-side clearance at pressure sensing chamber side thereof therebetween.

7. A control valve, for a variable displacement compressor, according to claim 4, wherein the solenoid is configured by including a core fixed to the body, a plunger configured to support the other end of the actuating rod and configured to transmits force to the valve element, and a magnetic coil configured to generate a magnetic circuit that includes the plunger and the core when the solenoid electrically conducts, wherein the plunger is configured such that a first plunger disposed counter to the core and a second plunger supporting the other end of the actuating rod are axially placed in series with each other, wherein a pressure-sensing member that senses the pressure to be sensed is placed between the first plunger and the second plunger, as the pressure-sensing section, and a biasing member that biases the second plunger in a valve opening direction is provided, and wherein, when the solenoid electrically conducts, the first plunger and the second plunger operate integrally via the pressure-sensing member; when the solenoid does not electrically conduct, the second plunger is located in such a position as to be separated away from the first plunger by a biasing force of the biasing member.

* * * * *